United States Patent [19]

Oard

[11] 4,303,810

[45] Dec. 1, 1981

[54] TWO SPEED SWITCH

[76] Inventor: Eugene E. Oard, 1306 Lakeshore, Rockwall, Tex. 75087

[21] Appl. No.: 88,559

[22] Filed: Oct. 29, 1979

[51] Int. Cl.[3] ..... H01H 3/12

[52] U.S. Cl. ..... 200/5 R; 200/18; 200/50C; 318/280

[58] Field of Search ..... 200/5 R, 5 B, 5 C, 18, 200/50 C; 318/280

[56] References Cited

U.S. PATENT DOCUMENTS 2,639,337 5/1953 Framhein ..... 200/18 X

*Primary Examiner*—S. J. Witkowski
*Assistant Examiner*—Morris Ginsburg
*Attorney, Agent, or Firm*—Richards, Harris & Medlock

[57] ABSTRACT

A two speed switch (20) for electric motors permits both forward and reverse operation of the motors and eliminates the possibility of simultaneous operation of the switch in both directions. The switch (20) includes a housing (50, 80) for receiving a contact bar (140) therein. First, second and third contact terminal poles (66, 68, 70) are spaced along the longitudinal length of the contact bar (140) within the housing with the third terminal pole (70) positioned on the opposite side of the contact bar (140) from the first and second terminal poles (66, 68). The terminal poles are positioned such that when the contact bar (140) engages two of the terminal poles, it is not in engagement with the third terminal pole. First and second biasing structures (28, 30) engage the bar and normally position the bar against the first and second terminal poles. Upon actuation of the first biasing structure, the bar engages the third terminal pole (70) to close a circuit between the second terminal pole (68) and third terminal pole (70) to drive the motor in a first direction. Upon actuation of the second biasing structure (30), the contact bar (140) pivots about the first terminal pole (66) and engages the third terminal pole (70) to close a circuit between the first terminal pole (66) and third terminal pole (70) to drive the motor in a second direction. A switch (180) for operating the first and second speeds of the motor is positioned on the opposite side of the third terminal pole (70) from the contact bar (140). The switch (180) is operable by overtravel of the first or second biasing structure to close the appropriate circuits to operate the motor in either a first or second speed only when the circuit for operating the motor in either the forward or reverse direction is likewise closed.

15 Claims, 9 Drawing Figures

TWO SPEED SWITCH

TECHNICAL FIELD

The present invention relates to switches for electric motors and more specifically to a two speed switch providing forward and reverse control at both speeds.

BACKGROUND ART

Remote switches are used in many applications to control the operation of multiphase electric motors. Generally, switches must be capable of energizing a motor in either a forward or reverse direction. In other operations, the switch must be capable of operating the motor between one or more speeds, both in the forward and reverse directions.

In the construction of electric motor switches, it is preferred that the switch be both simple in construction and protect against simultaneous operation of the switch in both the forward and reverse directions. It is readily appreciated that if a switch is capable of simultaneous operation in both directions, severe damage can be imparted to the motor controlled by the switch. Thus, this feature is extremely important in switch design. In the past, to accomplish automatic interlocking to protect against simultaneous operation of the motor in both directions, switch designs have been overly complex requiring substantial interrelated wiring to accomplish the desired goal. The complexity of switch design is compounded when a two speed switch must be provided. While this is readily accomplished, switches designed to do so in a way eliminating the possibility of simultaneous operation in both directions have been overly complex involving substantial cross wiring and thus additional components. This complexity has added to the cost, as well as the difficulty in repair and inspection of such switches.

An example of a two speed switch providing both forward and reverse directional control is that manufactured by Square D. Electric Co. of Milwaukee, Wis. and identified as a TJ-2 microswitch. The complexity of such a switch is readily evident upon even a casual examination of the jumper wires required between various contacts employed in the switch unit. Similar complexity is found in a two speed cam operated switch identified as the PBC switch manufactured by Euclid Electric Co. of Madison, Ohio.

Therefore, a need has arisen for a two speed switch for forward and reverse control of electric motors which eliminates the possibility of simultaneous operation of both directions of the switch without requiring the complexity heretofore required by prior art units.

DISCLOSURE OF THE INVENTION

The present invention provides an improved two speed switch for multiphase electric motors permitting both forward and reverse operation of the motors and eliminating the possibility of simultaneous operation of the switch in both directions.

In accordance with one embodiment of the invention, the two speed switch includes a housing for receiving a contact bar therein. First, second and third contact terminal poles are spaced along the longitudinal length of the contact bar within the housing with the third terminal pole positioned on the opposite side of the contact bar from the first and second terminal poles. The terminal poles are positioned such that when the contact bar engages two of the terminal poles, it is not in engagement with the other terminal pole.

First and second biasing structures engage the bar with the first biasing structure being positioned on the opposite side of the second biasing structure from the second terminal pole. The second biasing structure is positioned on the opposite side of the first biasing structure from the first terminal pole. The first and second biasing structures normally position the bar against the first and second terminal poles and permit selective movement of the bar such that upon actuation of the first biasing structure, the bar is moved to pivot about the second terminal pole and engage the third terminal pole to close a circuit between the second terminal pole and third terminal pole. This closed circuit drives the motor in a first direction.

Upon actuation of the second biasing structure, the contact bar pivots about the first terminal pole and engages the third terminal pole to close a circuit between the first terminal pole and third terminal pole. Closing this circuit drives the motor in a second direction.

A switch structure for operating the first and second speeds of the motor is positioned on the opposite side of the third terminal pole from the contact bar. The switch structure is operable by overtravel of the first or second biasing structure to close the appropriate circuits to operate the motor in either a first or second speed only when the circuit for operating the motor in either the forward or reverse direction is likewise closed.

In accordance with another embodiment of the invention, the two speed switch includes a bridge structure positioned intermediate of the contact bar and the switch structure. The switch structure is operable by overtravel of the first or second biasing structure to engage the bridge structure. In this embodiment, the bridge structure includes a bridge bar having a main section with engagement hooks on each end thereof. Spaced pins, supported from the switch housing, are engaged by the engagement hooks such that the main section of the bridge bar engages the switch which biases the engagement hooks against the pins to set the position of the bridge bar.

The bridge bar is so positioned such that the first biasing structure engages the bar during overtravel at a point to the side of the first pin toward the switch. The second biasing structure engages the bar upon overtravel to the side of the second pin toward the switch. Overtravel of the first biasing means contacts the bridge bar to rotate the bar about the first pin to actuate the switch. Likewise, overtravel of the second biasing structure contacts the bridge bar to rotate the bar about the second pin to actuate the switch.

In accordance with still another embodiment of the invention, the first and second biasing structures each include a plunger extending through the switch housing and engaging the contact bar. A spring is positioned between the plunger and the switch housing and biases the plunger in a direction to normally engage the contact bar with the first and second terminal poles. A second spring is entrapped between the plunger and the contact bar and permits overtravel of the plunger relative to the bar by compression of the second spring after contact of the bar with the third terminal pole.

BRIEF DESCRIPTION OF THE DRAWINGS

For a more complete understanding of the present invention, and for further details and advantages thereof, reference is now made to the following description taken in conjunction with the accompanying drawings, in which.

DESCRIPTION OF THE PREFERRED EMBODIMENTS

Figure 1:
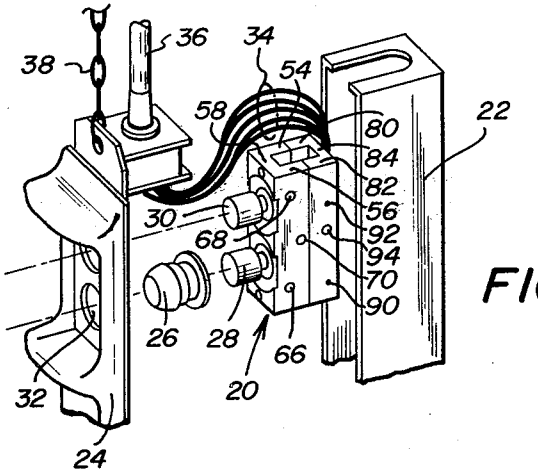
FIG. 1 is a perspective exploded view illustrating a two speed switch embodying the present invention and its associated case.

FIG. 1 illustrates a perspective exploded view of a switch 20 embodying the present invention. Switch 20 is normally mounted within a case 22 with an enclosure face 24. Switch 20 includes a main body portion with a pair of control buttons 28 and 30 extending therefrom. Switch 20 is mounted by appropriate fasteners (not shown) to enclosure face 24 with a rubber boot 26 positioned over control button 28. As is illustrated in FIG. 1, boot 26 is inserted over control button 28 and is received through aperture 32 in enclosure face 24. Although not shown, an identical rubber boot is positioned over control button 30.

Associated wiring 34 from switch 20 is directed into a shielded cable 36 and to motor control controlled by switch 20. The main body portion of switch 20 is protected by the attachment of case 22 to enclosure face 24 by suitable means such as pins or screws. The completed assembly is suspended from a cable or chain 38 attached through an aperture in the upper portion of enclosure face 24.

The illustration of the enclosure for a switch 20 shown in FIG. 1 is for the application of the present switch as a control for an overhead crane. One or more of the switches illustrated in FIG. 1 may be used to control movement of the hoist in an up or down direction, and movement of the trolley on which the crane is mounted in a forward or reverse direction. Still another switch 20 may be employed to operate the bridge on which the trolley is mounted in a forward or reverse direction. In operating each of these components of an overhead crane assembly, normally an electric motor is operated to effect the desired movement of either the crane, trolley or bridge. In each case, there is a need to operate the motor in either a forward or reverse direction and likewise there is, in many cases, a need to operate the motor in either a slow or accelerated mode. The present switch 20 provides a straightforward construction for the control of a two speed motor in either a forward or reverse direction while protecting against simultaneous operation of both directions of the switch. This is critical in that the switch must be designed to prevent simultaneous operation of both directions of a motor to avoid motor damage or failure. Likewise, the switch sould be of a design to minimize the wiring required and be sufficiently rugged to withstand the rugged use to which these devices are normally subjected. Such a switch is provided by the switch of the present invention.

Referring to FIG. 1, switch 20 includes upper and lower U-shaped casings 50 and 52, respectively. These sections are joined by appropriate bolts as will be illustrated hereinafter in greater detail. As can be seen in FIG. 1, upper casing 50 includes upstanding legs 54 and 56 joined by a back wall 58. A plurality of apertures are formed in the sidewall thereof to receive first, second, and third terminal poles 66, 68 and 70 therethrough. Likewise, lower casing 52 includes upstanding legs 80 and 82 joined by a back wall 84. Upstanding legs 80 and 82 have a plurality of apertures therein for receiving a first pin 90 and a second pin 92 therebetween.

Figure 2:
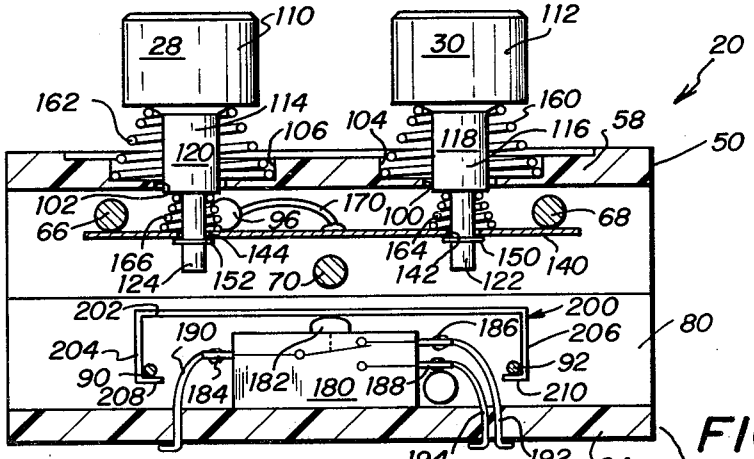
FIG. 2 illustrates a vertical section view of the switch illustrated in FIG. 1.

Referring now to FIG. 2, wherein a vertical section of switch 20 is illustrated, upper casing 50 has a first terminal pole 66 and a second terminal pole 68 extending between the upstanding legs. Poles 66 and 68 are substantially an equal distance from back wall 58. As will be seen hereinafter in greater detail, poles 66 and 68 are also substantially parallel to back wall 58.

Third terminal pole 70 extends between the upstanding legs of upper casing 50 and, as will be shown hereinafter in greater detail, is substantially parallel to back wall 58. As can be seen in FIG. 2, third terminal pole 70 is intermediate of the first and second terminal poles and positioned substantially further from back wall 58. Upstanding leg 54 receives a terminal element 96 as shown in FIG. 2.

Back wall 58 has a pair of apertures 100 and 102 formed therein with concentric recess bores 104 and 106 formed in the outer surface thereof. Control buttons 28 and 30 are identical in construction and each include cylindrical knobs 110 and 112, respectively, with shafts 114 and 116 extending therefrom. Shafts 114 and 116 include larger diameter portions 118 and 120, respectively, with smaller diameter shafts 122 and 124, respectively, extending from the larger portions along the longitudinal axis thereof. A contact bar 140 is formed from electrically conductive material and has a pair of apertures 142 and 144 therein. Smaller diameter shafts 122 and 124 of buttons 28 and 30 are received through apertures 142 and 144 of contact bar 140. Appropriate clip rings 150 and 152 engage the ends of the smaller diameter shafts 122 and 124 to connect contact bar 140 to control buttons 28 and 30.

A compression spring 160 is seated between knob 112 and the seat of bore 104 within upper casing 50 and biases the control button 30 upwardly, bringing contact bar 140 into engagement with second terminal pole 68. Similarly, a compression spring 162 is entrapped between knob 110 of control button 28 and bore 106 within upper casing 50 to bias button 28 upwardly to normally engage contact bar 140 against first terminal pole 66. A smaller compression spring 164 is entrapped between contact bar 140 and larger diameter portion 118 of control button 30 and encircling smaller diameter shaft 122. Spring 164 therefore biases contact bar 140 against clip ring 150 attached to smaller diameter shaft 122. Similarly, a smaller compression spring 166 is entrapped between contact bar 140 and larger diameter portion 120 of control button 28 to normally bias contact bar 140 against clip ring 152.

Referring still to FIG. 2, a flexible electrical lead 170 is connected between contact bar 140 and terminal 96. This connection may be by soldering or other suitable means.

Referring now to the lower casing 52, pins 90 and 92 are seen extending from upstanding leg 80 of casing 52. As will be shown hereinafter in greater detail, pins 90 and 92 are substantially parallel to back wall 84 of lower casing 52 and substantially perpendicular to leg 80. A high-low switch 180 is mounted to back wall 84 of lower casing 52 intermediate of pins 90 and 92 and includes an outwardly biased switch button 182. Switch 180 has terminals 184, 186 and 188 extending therefrom. As is shown schematically in FIG. 2, switch 180 is normally closed between terminals 184 and 186. Engagement of switch button 182 opens the circuit between terminals 184 and 186 and closes the circuit between terminals 184 and 188. A lead 190 is connected from terminal 184 and extends through back wall 84 as illustrated. Leads 192 and 194 are attached from terminals 186 and 188, respectively, and likewise extend through back wall 84 of lower casing 52.

A bridge unit 200 is mounted between pins 90 and 92 and over switch button 182. Bridge 200 includes a main portion 202 with depending legs 204 and 206 extending perpendicularly therefrom. The ends of legs 204 and 206 remote from main portion 202 are formed with feet 208 and 210 to engage pins 90 and 92 as shown. Legs 204 and 206 of bridge 200 are so dimensioned and high-low switch 180 is so positioned such that switch button 182 normally engages the main portion 202 of bridge 200 and biases the bridge upwardly such that feet 208 and 210 engage pins 90 and 92.

Figure 3:
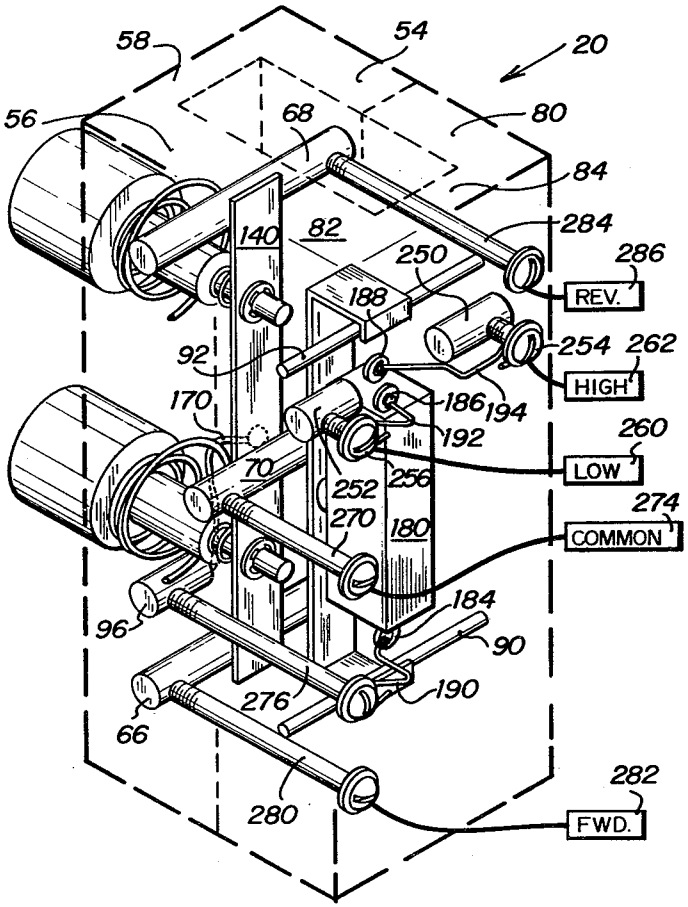
FIG. 3. illustrates a perspective view of the switch illustrated in FIG. 1 showing the switch housing in phantom to reveal the interior operating components and electrical connections.

Referring to FIG. 3, upper casing 50 and lower casing 52 are shown in phantom to facilitate illustration of the internal components of the switch. As is seen in FIG. 3, the first, second and third terminal poles 66, 68 and 70, respectively, have their ends seated within upstanding legs 54 and 56 of upper casing 50 and are substantially parallel to back wall 58 of casing 50. As is also seen in FIG. 3, bridge pins 90 and 92 have their ends received within upstanding legs 80 and 82 of lower casing 52 and are substantially parallel to back wall 84 of casing 52.

As is also illustrated in FIG. 3, terminal 96 is received within leg 56 of upper casing 50 and lead 170 is attached between terminal 96 and contact bar 140.

Referring still to FIG. 3, terminal pins 250 and 252 are received within the upstanding legs 80 and 82 of lower casing 52. In a primary embodiment of the invention, bolts 254 and 256 are received through back wall 84 of casing 52 and are threadedly received within terminal pins 250 and 252. Lead 192 extends from terminal 186 of high-low switch 180 with its opposite end looped beneath the head of bolt 256. Likewise, lead 194 extends from terminal 188 with its opposite end looped beneath the head of bolt 254. As is shown schematically in FIG. 3, in wiring the switch of the present invention to a motor having a high and low speed in forward and reverse directions, the low terminal 260 is connected to switch 20 at bolt 256. Similarly, the high terminal of the motor is connected to switch 20 at bolt 254.

A bolt 270 extends through back wall 84 of lower casing 52 through upstanding leg 82 of casing 52 and into upstanding leg 56 of upper casing 50. Bolt 270 is then threadedly received into the end of third terminal pole 70 within upstanding leg 56 of upper casing 50. As is illustrated in FIG. 3, the common terminal 274, or power source hot wire is connected to bolt 270 by connecting a lead beneath the head of bolt 270.

A bolt 276 is engaged through back wall 84, through upstanding leg 82 of lower casing 52. Bolt 276 extends into upstanding leg 56 of upper casing 50 and it threadedly engages terminal 96. Referring still to FIG. 3, lead 190 is engaged between terminal 184 of high-low switch 180 with its opposite end engaged beneath the head of bolt 276. This connection couples terminal 184 of high-low switch 180 with contact bar 140 by way of lead 190, bolt 276, terminal 96 and lead 170.

A bolt 280 extends through back wall 84 and upstanding leg 82 of casing 52 and into upstanding leg 56 where it is threadedly received within first terminal pole 66. As is indicated in FIG. 3, the forward terminal 282 of the motor controlled by switch 20 is connected to bolt 280 as by engaging a lead beneath the head of bolt 280. A bolt 284 extends through back wall 84 and upstanding leg 80 of casing 52 and into upstanding leg 54 of casing 50 where it is threadedly received within second terminal pole 68. The reverse terminal 286 of the motor controlled by switch 20 is connected to bolt 284 as by engaging a lead beneath the head of bolt 284.

Figure 4:
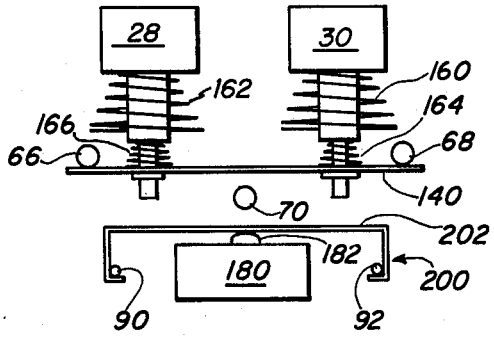
FIGS. 4–9 illustrate schematic representations of the operation of the switch illustrated in FIG. 1.
Figure 5:
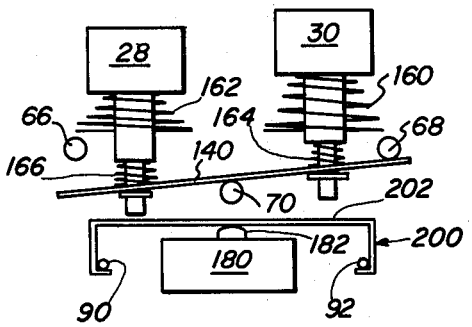

The operation of the switch of the present invention is illustrated schematically in FIGS. 4–9. Specifically, FIG. 4 illustrates the switch with neither control button 28 nor 30 depressed and therefore the switch in an off position. Referring to the position of switch 20 in FIG. 5, control button 28 has been depressed to the point that contact bar 140 has been disengaged from contact with first terminal pole 66 and has engaged third terminal pole 70. As can be seen in FIG. 5, compression spring 160 retains control button 30 in the up position to retain contact bar 140 in engagement with second terminal pole 68. By engaging third terminal pole 70 and maintaining engagement of contact bar 140 with second terminal pole 68, connection is made between the common terminal 274 and the reverse terminal 286. Closing the circuit between these two terminals results in energizing the motor controlled by the switch in the reverse direction. Simultaneously therewith, low speed terminal 260 is connected to common terminal 274 by way of switch 180, lead 190, bolt 276, terminal 96, lead 170, bar 140, third terminal pole 70 and bolt 270.

Figure 6:
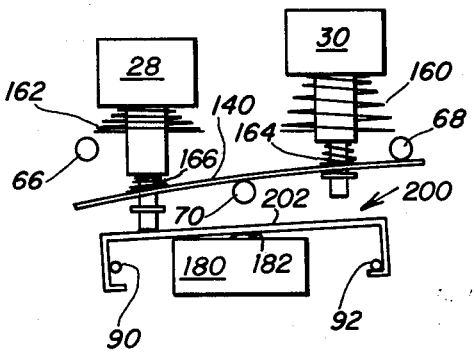

In FIG. 6, control button 28 is depressed to an overtravel position such that spring 166 is compressed to permit the extending of small diameter shaft 124 of control button 28 to engage bridge unit 200. Upon engaging bridge unit 200, main portion 202 is pivoted toward high-low switch 180 to depress switch button 182. With switch button 182 depressed, high-low switch 180 is switched to its high position. In this position, contact is made across the high-low switch from terminal 184 to terminal 188, closing a circuit between high terminal 262 and common terminal 274 by way of switch 180, lead 190, bolt 276, terminal 96, lead 170, bar 140, third terminal pole 70 and bolt 270. This energizes the high speed of the motor controlled by switch 20 in the reverse direction.

Figure 7:
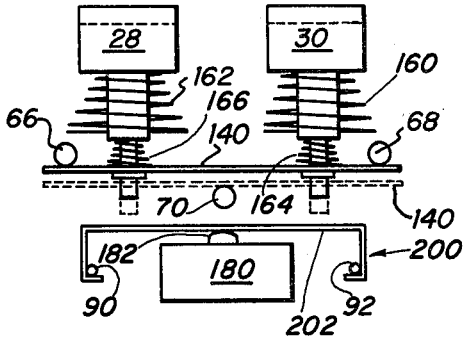

Referring to FIG. 7, control button 28 has been released and under the action of compression spring 162, contact bar 140 has been raised to its normal position such that it engages first terminal pole 66 and second terminal pole 68. This represents the "off" position for switch 20.

FIG. 7 also represents switch 20 wherein both buttons 28 and 30 are depressed simultaneously. Simultaneous depression of buttons 28 and 30, illustrated in phantom lines, displaces contact bar 140 from terminal poles 66 and 68. As can be seen from FIG. 2, when this occurs, an open circuit exists between common terminal 274 and forward terminal 282. Likewise, an open circuit exists between common terminal 274 and reverse terminal 286. Thus, with both control buttons depressed simultaneously, switch 20 cannot energize the motor control thereby and the possibility of the energizing motor in both a forward and reverse direction simultaneously is eliminated.

Figure 8:
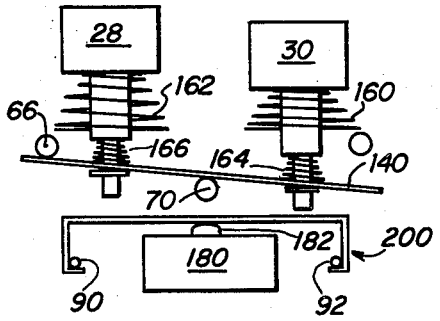

Referring to FIG. 8, control button 30 is engaged, compressing spring 160 to rotate contact bar 140, bringing it into engagement with third terminal pole 70. Under the action of spring 162, control button 28 is maintained in its upward position to maintain contact bar 140 in engagement with first terminal pole 66. In this way, a circuit is closed between first terminal pole 66 and third terminal pole 70. Referring to FIG. 3, this contact results in closing the circuit between forward terminal 282 and common terminal 274 of the motor controlled by switch 20.

Figure 9:
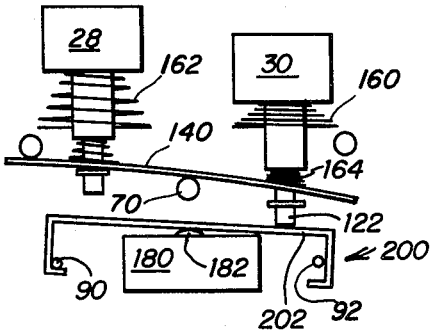

Referring to FIG. 9, switch 20 is shown with control button 30 depressed further than that illustrated in FIG. 8 to the extent that spring 164 is compressed to permit the engagement of small diameter shaft 122 of control button 30 to engage bridge unit 200. Specifically, shaft 122 engages main portion 202 of bridge unit 200 to rotate main portion 202 about the contact of bridge unit 200 with pin 90. As a result, switch button 182 of switch 180 is depressed to switch high-low switch 180 from the normal low position to its high position such that a circuit is closed between terminals 184 and 188 and the normally closed circuit between terminals 184 and 186 is opened. Referring to FIG. 3, this results in the contact of the high terminal 262 of the motor controlled by switch 20 with the common terminal 274. This is accomplished by the connection of terminal 184 of high-low switch 180 through lead 190, bolt 276, terminal 96, lead 170, contact bar 140, third terminal pole 70 and bolt 270. As a result, the motor controlled by switch 20 is maintained in the forward mode at high speed.

Referring to the operation of the switch illustrated in FIGS. 4–9, it can be appreciated that in view of the arrangement of the terminal poles 66, 68 and 70 and the configuration of contact bar 140, the switch can never be operated such that a circuit is closed between all of these terminals simultaneously. Thus, the possibility of simultaneous operation of the motor controlled by the switch in both the forward and reverse directions is eliminated. Likewise, operating the motors in a low or high mode simultaneously is also eliminated by the operation of high-low switch 180. Further, combining the operation of the switch to control the motors between a forward and reverse direction with an appropriate control of the motor between a low and high speed is uniquely provided in a very compact package using a minimum of interconnection between the respective switch terminals.

Therefore, the present invention discloses a two speed switch for the control of an electric motor in either a forward or reverse direction which eliminates the possibility of simultaneous operation of the motor in a forward and reverse direction. Further, the switch provides for a controlled operation in either direction between a low or high speed.

Although preferred embodiments of the invention have been described in the foregoing detailed description and illustrated in the accompanying drawings, it will be understood that the invention is not limited to the embodiments disclosed, but is capable of numerous rearrangements, modifications and substitutions of parts and elements without departing from the spirit of the invention. The present invention is therefore intended to encompass such rearrangements, modifications and substitutions of parts and elements as fall within the scope of the appended claims.

I claim:

1. A two speed switch for operating a motor in a first and a second direction at a first and second speed, comprising:

a housing, a contact bar positioned in the housing, first, second and third terminal poles supported in said housing and spaced along the longitudinal length of said contact bar with the third terminal pole being on the opposite side of said bar from said first and second terminal poles, said terminal poles being positioned such that when said contact bar engages two of said terminal poles it does not engage said other terminal pole, first and second biasing means for engaging said bar, said first biasing means being positioned on the opposite side of said second biasing means from said second terminal pole, said second biasing means being positioned on the opposite side of said first biasing means from said first terminal pole, said first and said second biasing means normally positioning said bar against said first and second terminal poles and permitting selective movement of said bar such that, upon actuation of said first biasing means, said bar is moved to pivot about said second terminal pole and engage said third terminal pole to close a circuit between said second terminal pole and said third terminal pole to drive the motor in the first direction, and upon actuation of said second biasing means, said bar pivots about said first terminal pole and engages said third terminal pole to close a circuit between said first terminal pole and said third terminal pole to drive the motor in the second direction, and switch means for operating the first and second speeds of said motor, and positioned on the opposite side of said third terminal pole from said bar, said switch means being operable by overtravel of said first and second biasing means.

2. The two speed switch according to claim 1 further comprising:

bridge means positioned intermediate of said contact bar and said switch means, said switch means being operable by overtravel of said first and second biasing means to engage said bridge means.

3. The two speed switch according to claim 2 wherein said bridge means includes a bridge bar having a main section with engagement means on each end thereof, and spaced first and second pins engaging said engagement means such that said switch means engages said main section and biases said engagement means against said first and second pins, said bridge bar being positioned such that said first biasing means engages said bar to the side of said first pin toward said switch means and said second biasing means engages said bar to the side of said second pin toward said switch means, whereby overtravel of said first biasing means contacts said bridge bar to rotate said bar about said first pin to actuate said switch means and whereby overtravel of said second biasing means contacts said bridge bar to rotate said bar about said second pin to actuate said switch means.

4. The two speed switch according to claim 1 wherein said first and second biasing means each comprise:

a structure supporting said terminal poles, a plunger extending through said support structure and engaging said contact bar, and spring means positioned between said plunger and said structure for biasing said plunger in a direction to normally engage said contact bar with said first and second terminal poles.

5. The two speed switch according to claim 4 wherein said first biasing means further includes:

second spring means entrapped between said plunger and said contact bar for permitting overtravel of said plunger relative to said bar after contact of said bar with said third terminal pole.

6. A two speed switch for operating a motor in a first and a second direction at a first and second speed, comprising:

a contact bar, first, second and third terminals, wherein closing a circuit across said first and third terminals operates the motor in a first direction and closing a circuit across said second and third terminals operates the motor in a second direction, first bias means for selectively moving said contact bar to engage said first and third terminals, second bias means for selectively moving said contact bar to engage said second and third terminals, and switch means for operating the first and second speeds of said motor and positioned to be engaged by overtravel of either said first or second bias means, said switch means being operable to operate the first or second speed of said motor when said contact bar is in engagement with said third terminal.

7. The two speed switch according to claim 6 further comprising:

bridge means positioned intermediate of said contact bar and said switch means, said switch means being operable by overtravel of said first and second bias means to engage said bridge means.

8. The two speed switch according to claim 7 wherein said bridge means includes a bridge bar having a main section with engagement means on each end thereof, and spaced first and second pins engaging said engagement means such that said switch means engages said main section and biases said engagement means against said first and second pins, said bridge bar being positioned such that said first bias means engages said bar to the side of said first pin toward said switch means and said second bias means engages said bar to the side of said second pin towards said switch means, whereby overtravel of said first bias means contacts said bridge bar to rotate said bar about said first pin to actuate said switch means and whereby overtravel of said second bias means contacts said bridge bar to rotate said bar about said second pin to actuate said switch means.

9. The two speed switch according to claim 6 wherein said first and second bias means each comprise:

a structure supporting said first, second and third terminals, a plunger extending through said support structure and engaging said contact bar, and spring means positioned between said plunger and said structure for biasing said plunger in a direction to normally engage said contact bar with said first and second terminals.

10. The two speed switch according to claim 9 wherein said first and second bias means each comprise:

second spring means entrapped between said plunger and said contact bar for permitting overtravel of said plunger relative to said bar after contact of said bar with said third terminal.

11. A two speed switch for controlling the operation of an electric motor comprising:

a contact bar, first, second and third terminals positioned relative to said contact bar whereby only two of the contacts may be engaged by said contact bar at any one time, said first terminal for connection to said motor to provide forward control thereof, said second terminal for connection to said motor to provide reverse control thereof, and said third terminal for connection to an appropriate power source, first bias means for selectively moving said contact bar to engage said first and third terminals to operate the motor in a forward direction, second bias means for selectively moving said contact bar to engage said second and third terminals to operate the motor in a reverse direction, and switch means for selectively connecting the power source to the motor to operate the motor in either a high or low mode of operation, said switch means having a first terminal connected to said contact bar and second and third terminals for connection, respectively, to a low and high control to the motor, said switch means being operable between a first position wherein a circuit is closed between the first and second terminals and a second position wherein a circuit is closed between the first and third terminals by overtravel of either the first or second bias means whereby said contact bar is in engagement with said third terminal.

12. The two speed switch according to claim 11 further comprising:

bridge means positioned intermediate of said contact bar and said switch means, said switch means being operable by overtravel of said first and second bias means to engage said bridge means.

13. The two speed switch according to claim 12 wherein said bridge means includes a bridge bar having a main section with engagement means on each end thereof, and spaced first and second pins engaging said engagement means such that said switch means engages said main section and biases said engagement means against said first and second pins, said bridge bar being positioned such that said first bias means engages said bar to the side of said first pin toward said switch means and said second bias means engages said bar to the side of the second pin toward said switch means, whereby overtravel of said first bias means contacts said bridge bar to rotate said bar about said first pin to actuate said switch means and overtravel of said second bias means contacts said bridge bar to rotate said bar about said second pin to actuate said switch means.

14. The two speed switch according to claim 11 wherein said frist and second bias means each comprise:

a structure supporting said first, second and third terminals, a plunger extending through said support structure and engaging said contact bar, and spring means positioned between said plunger and said structure for biasing said plunger in a direction to normally engage said contact bar with said first and second terminals.

15. The two speed switch according to claim 14 wherein said first and second bias means each comprise:

second spring means entrapped between said plunger and said contact bar for permitting overtravel of said plunger relative to said bar after contact of said bar with said third terminal.

* * * * *